US008333555B2

(12) United States Patent
Mokulys et al.

(10) Patent No.: US 8,333,555 B2
(45) Date of Patent: Dec. 18, 2012

(54) MULTIFREQUENCY CONTROL STAGE FOR IMPROVED DAMPENING OF EXCITATION FACTORS

(75) Inventors: Thomas Mokulys, Wuerenlingen (CH); Vishal Borikar, Nussbaumen (CH); Giorgio Zanazzi, Baden (CH); Pierre-Alain Masserey, Wuerenlos (CH); Michael Sell, Zurich (CH)

(73) Assignee: Alstom Technology Ltd., Baden (CH)

( * ) Notice: Subject to any disclaimer, the term of this patent is extended or adjusted under 35 U.S.C. 154(b) by 669 days.

(21) Appl. No.: 12/545,238

(22) Filed: Aug. 21, 2009

(65) Prior Publication Data

US 2010/0047064 A1 Feb. 25, 2010

(30) Foreign Application Priority Data

Aug. 22, 2008 (EP) ..... 08162848

(51) Int. Cl.
*F01D 9/04* (2006.01)

(52) U.S. Cl. ..... 415/159; 415/184; 415/185; 415/194; 415/195

(58) Field of Classification Search ..... 415/159, 415/183, 184, 185, 191, 194, 195
See application file for complete search history.

(56) References Cited

U.S. PATENT DOCUMENTS

| | | | | |
|---|---|---|---|---|
| 1,894,117 | A * | 1/1933 | Somes et al. | 415/144 |
| 2,186,952 | A | 1/1940 | Bloomberg | |
| 4,780,057 | A | 10/1988 | Silvestri, Jr. | |
| 5,080,558 | A | 1/1992 | Tran | |
| 5,409,351 | A * | 4/1995 | Geist | 415/159 |
| 6,402,465 | B1 * | 6/2002 | Maier | 415/159 |

FOREIGN PATENT DOCUMENTS

| | | |
|---|---|---|
| FR | 724732 | 5/1932 |
| GB | 295639 | 9/1928 |
| JP | 54-065203 A | 5/1979 |

OTHER PUBLICATIONS

European Search Report of Application No. 08 162 848.9 dated Jul. 20, 2009.

* cited by examiner

*Primary Examiner* — Igor Kershteyn
(74) *Attorney, Agent, or Firm* — Buchanan Ingersoll & Rooney PC

(57) ABSTRACT

An exemplary control stage of a steam turbine is disclosed, which includes plural staging valves circumferentially distributed around the turbine for regulating steam admission flow so as to control the loading of the turbine. Nozzle chambers are connected to a downstream end of each staging valve. An arc of admission forms the downstream portion of each nozzle chamber, and control stage nozzles in the arcs of admission define the downstream end of the nozzle chamber. Each nozzle chamber has at least two arcs of admission, each with a different circumferential dimension.

7 Claims, 2 Drawing Sheets

MULTIFREQUENCY CONTROL STAGE FOR IMPROVED DAMPENING OF EXCITATION FACTORS

RELATED APPLICATION

This application claims priority under 35 U.S.C. §119 to European Patent Application No. 08 162 848.9 filed in Europe on Aug. 22, 2008, the entire content of which is hereby incorporated by reference in its entirety.

FIELD

The present application discloses steam turbine control stage arrangements.

BACKGROUND INFORMATION

Known methods for throttling the power output of a multistage steam turbine system use a divided steam feed system in which the steam enters the turbine inlet via numerous isolatable and individually controllable arcs of admission. In this method, known as partial arc admission, a number of active first stage nozzles is varied in response to load changes. However, partial arc admission systems in the past have been known to possess limited efficiency of work output across the control stage. Some of these limitations are due to unavoidable mechanical constraints, such as, for example, an unavoidable amount of windage and turbulence, which can occur as rotating blades pass nozzle groups that are not discharging steam. This can result in mechanical excitation of the blades, which can particularly impact the first blade rows that follow the control stage. To address this, the distance between the arcs of admission and the rotating blades can be increased to increase a volume for mixing and provide more even flow distribution to the blades. However this configuration increases overall turbine length.

It is also known to reduce the effect of mechanical excitation of airfoils and enable a shortening of the mixing section of a turbine by making blades and nozzles stiffer. However, such an approach is contradictory to the demand of increased efficiency as stiffer blades can reduce performance.

U.S. Pat. No. 4,780,057 A1 discloses a partial arc admission system having suitably arranged control stage nozzles with a variable aspect ratio wherein the variable aspect ratio can address steam distribution. U.S. Pat. No. 5,080,558 A1 discloses utilizing variably dimensioned control nozzles.

SUMMARY

A control stage for a steam turbine is disclosed, wherein the control stage comprises: plural staging valves circumferentially distributed for regulating steam admission flow to control loading of a steam turbine; a nozzle chamber connected to a downstream end of each staging valve; at least two arcs of admission forming downstream portions of each nozzle chamber; and plural control stage nozzles in the arcs of admission at the downstream end of each nozzle chamber, wherein a downstream end of the arcs of admission of each nozzle chamber includes a circumferential dimension that is different.

BRIEF DESCRIPTION OF THE DRAWINGS

Other objectives and advantages will become apparent from the following description, taken in connection with the accompanying drawings wherein by way of illustration, an exemplary embodiment is disclosed. The exemplary embodiment is described more fully hereinafter with reference to the accompanying drawings, wherein like reference numerals are used to refer to like elements in which.

DETAILED DESCRIPTION

Figure 1:
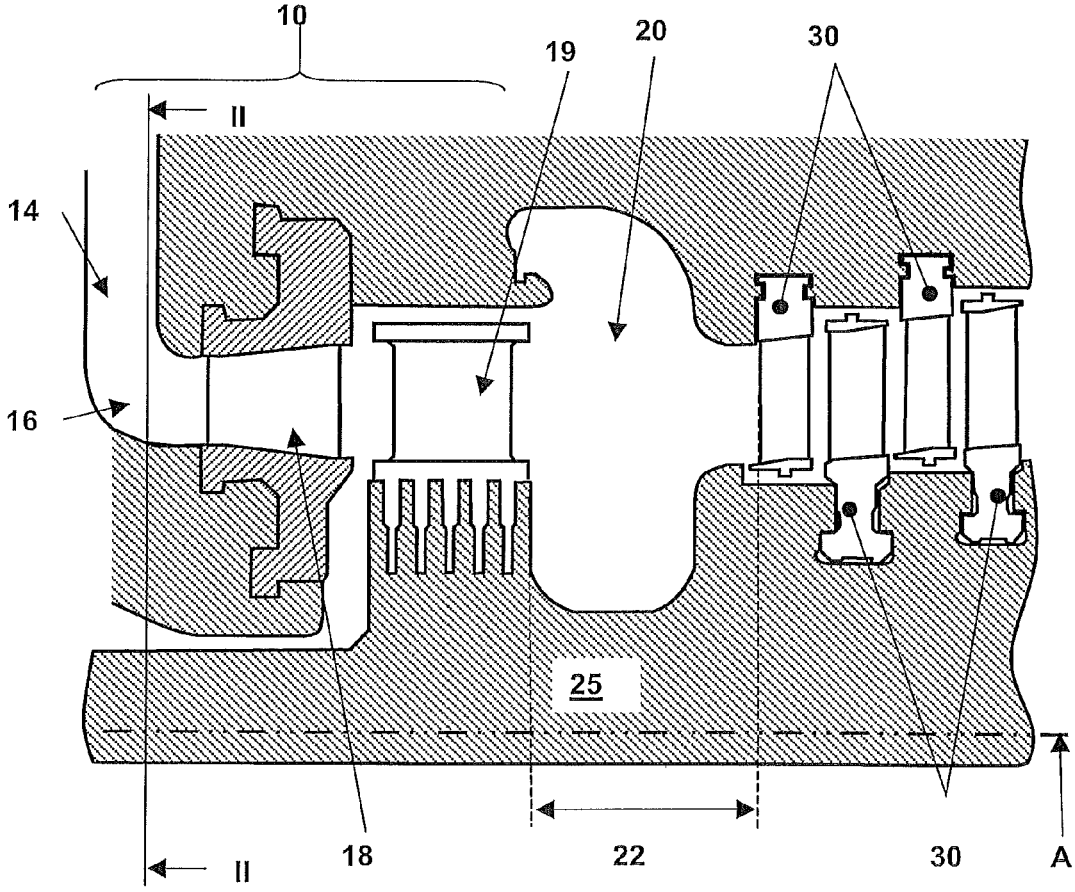
FIG. 1 is a side sectional view of an exemplary steam turbine with a control stage.

The present application discloses exemplary embodiments which can address a lack of circumferential steam distribution uniformity in a control stage of a partial arc admission system. For example, exemplary embodiments provide multiple arcs of admission for each nozzle chamber of a turbine and arrange and size the arcs in a manner as disclosed herein.

It has been found that up to a point of even circumferential flow when a turbine is fully loaded, the higher the frequency of excitation generated by a control stage, the more efficient the mixing in a mixing chamber which can reduce cyclical stressing of standard blades. This observation has been utilized to provide a control stage for a steam turbine, wherein the control stage comprises: a plurality of staging valves circumferentially distributed around the turbine for regulating steam admission flow so as to control the loading of the turbine; nozzle chambers connected to a downstream end of each staging valve; an arc of admission forming a downstream portion of each nozzle chamber; and control stage nozzles in arcs of admission defining a downstream end of the nozzle chamber wherein each nozzle chamber includes at least two arcs of admission each with a different circumferential dimension.

Exemplary embodiments can also include a control stage wherein each arc of admission is circumferentially interspersed by the arcs of admission of another nozzle chamber to provide relatively improved steam circumferential feed uniformity and a higher feed harmonic. The control stage can, for example, include four staging valves wherein each nozzle chamber has two arcs of admission arranged and configured such that when two circumferentially diagonally opposite staging valves are open, the arcs of admission corresponding to the open staging valves are interspersed by arcs of admission corresponding to closed staging valves, thereby exciting the $2^{nd}$ harmonic. When the turbine is further loaded by the opening of yet another control valve, excitation occurs between a $2^{nd}$ and $3^{rd}$ harmonic and can provide a significantly improved dampening effect. The dampening effect from this arrangement can be beneficially used to, for example, reduce a mechanical stress differential on standard blades by ensuring a more even steam flow passing from the mixing chamber, or can otherwise enable a shortening of the mixing chamber thereby making it possible to increase the number of fitted standard blades and improve overall machine efficiency for a given machine rotor length. Further this benefit can, for example, be achieved without increasing a number of control valves that would be a costly complex alternative.

By unbalancing steam addition through different arcs of admission, further improvement in the stress loading on standard blades can be achieved. This effect is provided by exemplary embodiments that provide at least one nozzle chamber configured to ensure that in operation a feed density through the arcs of admission of that nozzle chamber differ.

The actual amount of imbalance is dependent on, for example, desired design and performance of a given machine taking into account reduce machine efficiency that may result from such imbalance.

In the following description, for purposes of explanation, numerous specific details are set forth to provide a thorough understanding of the exemplary embodiments. It will be evident, however, that the embodiments may be practiced without these specific details. Throughout the specification, the circumferential reference refers to an arc that has a constant perpendicular distance from the turbine longitudinal axis.

FIG. 1 shows a side view of a steam turbine with an exemplary control stage 10 configured with a partial arc admission system. The control stage 10 comprises a staging valve 12, shown in FIG. 2 for controlling loading of the steam turbine. Connected downstream of the staging valve 12 is a nozzle chamber 14. As shown in FIG. 1, the downstream portion of the nozzle chamber 14 comprises an arc of admission 16 that has control stage nozzles 18 at its downstream end. The control stage nozzles 18 direct steam into rotating control stage blades 19 that are mounted on a rotor 25 and robustly configured to withstand variable steam distribution from the control stage nozzles 18 when the turbine is partially loaded. To further reduce the stress on standard turbine blades 30 located downstream of control blades 19, the control blades 19 are configured so that the majority (i.e., a greater amount) of turbine pressure loss can occur across them relative to the standard turbine blades. To yet further reduce standard blade 30 stresses, a mixing chamber 20 can be provided between the standard blades 30 and control stage blades 19. This mixing chamber 20 can be configured to provide a volume to ensure circumferential mixing of the steam. The length 22 of the mixing chamber 20 is defined as the distance between the downstream end of the control stage blades 19 and the upstream edge of the first standard blade 30.

Figure 2:
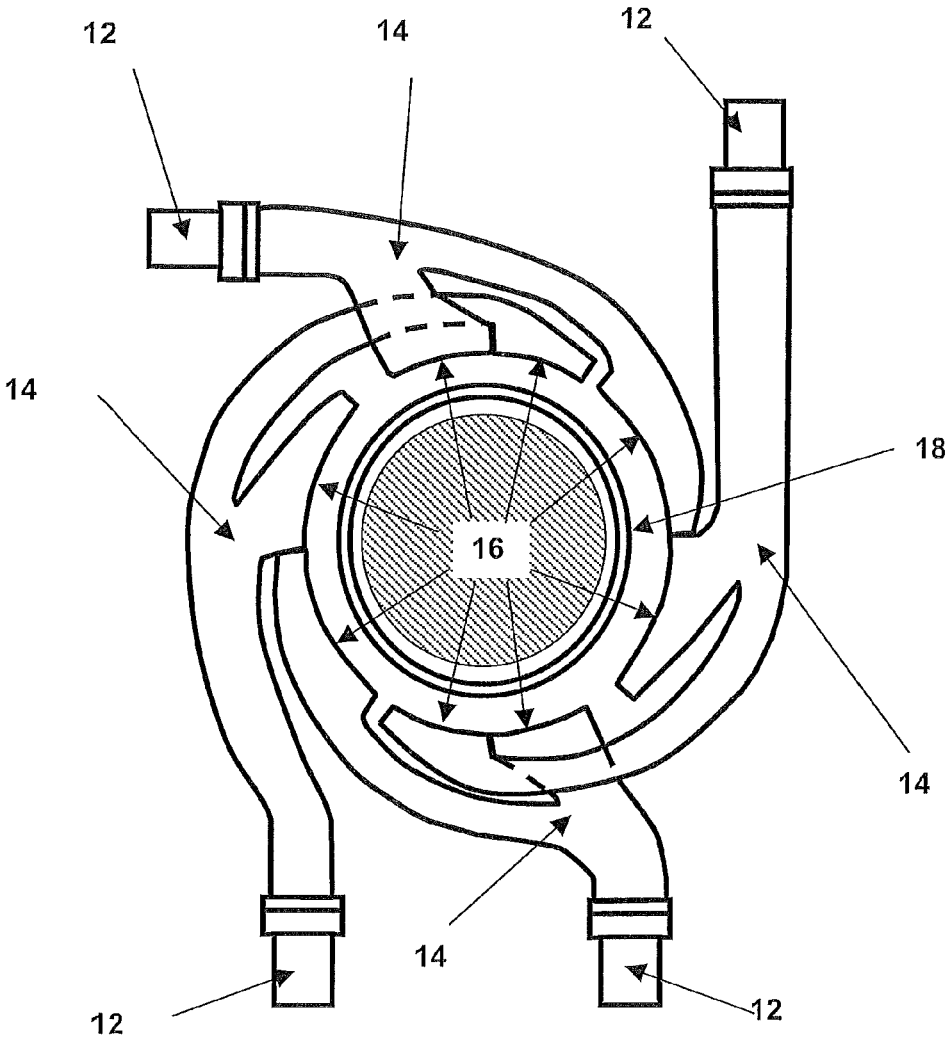
FIG. 2 is a cross sectional end view of an exemplary steam turbine control stage through II-II of FIG. 1, showing an exemplary partial arc admission control stage.

FIG. 2 shows details of an exemplary embodiment wherein the control stage comprises four staging valves 10, each connected to a nozzle chamber 14 having a downstream portion configured to provide arcs of admission 16. Each nozzle chamber 14 has two arcs of admission 16 wherein the arcs of admission 16 of each nozzle chamber 14 are interspersed with arcs of admission 16 of other nozzle chambers 14. In this arrangement, if two diagonally opposite staging valves 12 are opened the arcs of admission 16, forming the end portions of the nozzle chambers 14 of these open staging valves, are interspersed by an arc of admission 16 of nozzle chambers 14 which have closed staging valves 12.

Figure 3:
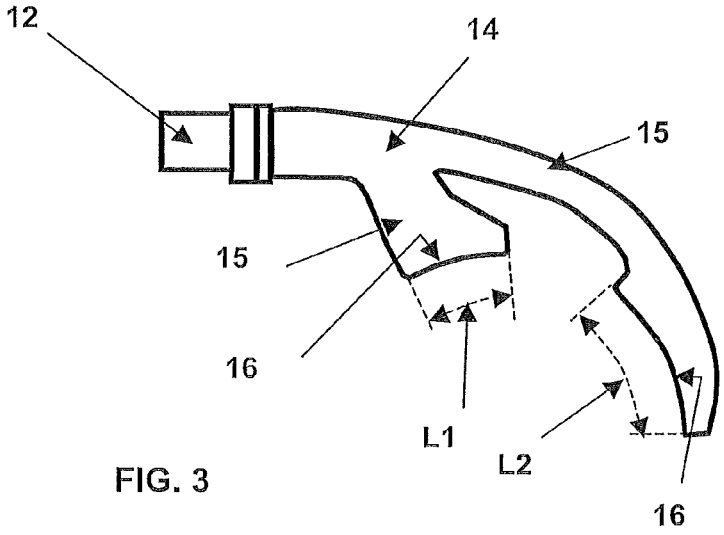
FIG. 3 is a detailed view of an exemplary nozzle chamber of FIG. 2.

FIG. 3 shows details of a nozzle chamber 14 of an exemplary embodiment that contains several features that can, for example, provide advantageous unbalancing of circumferential steam distribution. As shown, the circumferential dimensions L1, L2 of the two arcs of admission 16 is different. Further unbalancing can be achieved through the sizing and shaping of branches 15 of the nozzle chambers 14 combined with the design of the arc of admission 16, wherein the branches 15 split the steam flow of the nozzle chambers 14 and direct the split flow to the arcs of admission 16. In an exemplary embodiment, a nozzle chamber 14 is configured through size and shape, to provide different resistance to flow to each arc of admission 16. This can result in a variable feed density that creates an imbalance that can further reduce blade stress.

Although exemplary embodiments are shown and described, it is recognized that departures can be made within the scope of the invention, which is not to be limited to details described herein but is to be accorded the full scope of the appended claims so as to embrace any and all equivalent devices and apparatus. For example, while an embodiment has been described with reference to a single sided steam turbine, a two-sided steam turbine can be used. Other arrangements having, for example, a different number of staging valves 12 and arcs of admission 16 from that exemplified can also be used.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

REFERENCE NUMBERS

10 Control stage
12 Staging valve
14 Nozzle chamber
15 Nozzle chamber branches
16 Arcs of admission
18 Control stage nozzle
19 Control stage blade
20 Mixing chamber
22 Mixing chamber length
25 Rotor
30 Standard blades
A Machine axis
L1, L2 Circumferential dimension of an arc of admission

The invention claimed is:

1. A control stage for a steam turbine, wherein the control stage comprises:

plural staging valves circumferentially distributed for regulating steam admission flow to control loading of a steam turbine;

a nozzle chamber connected to a downstream end of each staging valve;

at least two arcs of admission forming downstream portions of each nozzle chamber; and plural control stage nozzles in the arcs of admission at the downstream end of each nozzle chamber, wherein a downstream end of one of the at least two arcs of admission of each nozzle chamber has a different circumferential dimension than a downstream end of another one of the at least two arcs of admission of the corresponding nozzle chamber.

2. The control stage of claim 1, wherein each arc of admission is circumferentially interspersed by arcs of admission of another nozzle chamber included in the control stage.

3. The control stage of claim 2, comprising:

four staging valves, wherein the two arcs of admission of each nozzle chamber are arranged and configured such that when two circumferentially diagonally opposite staging valves are open, the arcs of admission corresponding to the two open staging valves are interspersed by arcs of admission corresponding to closed staging valves.

4. The control stage of claim 1, wherein at least one nozzle chamber is configured to provide different resistance to flow through each of its two arcs of admission.

5. The control stage of claim 1, comprising: control stage blades for receiving steam from control stage nozzles operatively coupled with the nozzle chambers.

6. The control stage of claim 5, in combination with a steam turbine, wherein the plural staging valves are circumferentially distributed around the turbine, the turbine comprising:

turbine blades located downstream of the control stage blades, the control stage blades being configured such that a majority of turbine pressure occurs across the control stage blades relative to the turbine blades.

7. The control stage in combination with the steam turbine of claim 6, wherein the steam turbine comprises:

a mixing chamber between the control stage blades and the turbine blades with a volume configured to provide circumferential mixing of steam.

* * * * *